US007343283B2

(12) United States Patent
Ashley et al.

(10) Patent No.: US 7,343,283 B2
(45) Date of Patent: Mar. 11, 2008

(54) METHOD AND APPARATUS FOR CODING A NOISE-SUPPRESSED AUDIO SIGNAL

(75) Inventors: James Ashley, Naperville, IL (US); Michael McLaughlin, Palatine, IL (US)

(73) Assignee: Motorola, Inc., Schaumburg, IL (US)

( * ) Notice: Subject to any disclaimer, the term of this patent is extended or adjusted under 35 U.S.C. 154(b) by 1119 days.

(21) Appl. No.: 10/278,377

(22) Filed: Oct. 23, 2002

(65) Prior Publication Data

US 2004/0083095 A1 Apr. 29, 2004

(51) Int. Cl.
*G10L 19/00* (2006.01)

(52) U.S. Cl. ..... 704/219; 704/226

(58) Field of Classification Search ..... 704/219, 704/226–228, 233
See application file for complete search history.

(56) References Cited

U.S. PATENT DOCUMENTS 4,630,304 A * 12/1986 Borth et al. ..... 381/94.3
4,771,465 A * 9/1988 Bronson et al. ..... 704/207
4,937,873 A * 6/1990 McAulay et al. ..... 704/265
5,012,519 A * 4/1991 Adlersberg et al. ..... 704/226
5,659,622 A * 8/1997 Ashley ..... 381/94.1
5,680,508 A * 10/1997 Liu ..... 704/227
5,706,395 A * 1/1998 Arslan et al. ..... 704/226
5,839,101 A * 11/1998 Vahatalo et al. ..... 704/226

OTHER PUBLICATIONS

Yeldener et al, "A Background Noise Reduction Technique Based on Sinusoidal Speech Coding Systems", IEEE, ICASSP 2000, vol. 3 Jun. 2000, pp. 1391-1394.*
Mermelstein et al, "Nonlinear Filtering of the LPC Residual for Noise Suppression and speech Quality Enhancement", Speech Coding for Telecommunications Proceedings, 1997, Sep. 7-10; pp. 49-50.*

* cited by examiner

*Primary Examiner*—Michael Opsasnick

(57) ABSTRACT

An unfiltered frame portion (2) from a second frame (503) is blended together with a filtered frame portion (1) from a first frame (501) to produce a combined frame portion (507). The combined frame portion (507) is then buffered (110) along with the filtered frame (501) for LPC analysis.

6 Claims, 9 Drawing Sheets

600

—PRIOR ART—

—PRIOR ART—

—PRIOR ART—

—PRIOR ART—

500

600

METHOD AND APPARATUS FOR CODING A NOISE-SUPPRESSED AUDIO SIGNAL

FIELD OF THE INVENTION

The present invention relates generally to audio coding and in particular, to a method and apparatus for coding a noise-suppressed audio signal.

BACKGROUND OF THE INVENTION

Cellular telephones, speaker phones, and various other communication devices utilize background noise suppression to enhance the quality of a received signal. In particular, the presence of acoustic background noise can substantially degrade the performance of a speech communication system. The problem is exacerbated when a digital speech coder is used in the communication link, since such coders are tuned to specific characteristics of clean speech signals and handle noisy speech and background noise rather poorly.

A simplified block diagram of a basic noise suppression system 100 is shown in FIG. 1. Such a system is typically utilized to attenuate the input speech/noise signal when signal-to-noise (SNR) values are low. As shown, system 100 includes fast Fourier transformer (FFT) 101, and inverse FFT 102, total channel energy estimator 103, noise energy estimator 105, SNR estimator 106, and channel gain generator 104. During operation, the input signal (comprised of speech plus noise) is transformed into the frequency domain by FFT 101 and grouped into channels that are similar to critical bands of hearing. The channel signal energies are computed via estimator 103, and the background noise channel energies are conditionally updated via estimator 105 as a function of the spectral distance between the signal energy and noise energy estimates. From these energy estimates, the channel SNR vector is computed by estimator 106, which is then used to determine the individual channel gains. The channel gains are then applied via a mixer to the original complex spectrum of the input signal and inverse transformed, using the overlap-and-add method, to produce the noise suppressed output signal. As discussed above, when SNR values are estimated to be low, attenuation of the FFT signal takes place.

FIG. 2 shows the basic gain as a function of SNR for prior-art systems. From FIG. 2 it can be seen that for low channel SNR (i.e., less than an SNR threshold), the signal is presumed to be noise, and the gain for that channel is set to the minimum (in this case, −13 dB). As the SNR increases past the SNR threshold, the gain function enters a transition region, where the gain follows a constant slope of approximately 1, meaning that for every dB increase in SNR, the gain is increased by 1 dB. As the SNR is increased further (generally speech) the gain is clamped at 0 dB so as not to increase the power of the input signal. This gain function is representative of each channel of the communication system such that it is possible to have the gain in one channel be 0 dB while it can be −13 dB in another.

Prior-art noise suppression circuitry 100 additionally includes analysis circuitry 107 and synthesis circuitry 108. These components tend to blend signal discontinuities associated with the dynamics of the noise suppression system. More specifically, as the input speech+noise frames are processed, the filter gain characteristics within channel gain generator 104 change from frame to frame, thus leaving the potential for abrupt changes in output signal content at frame boundaries. Therefore, it is necessary to blend adjacent frames together by adding a decreasing signal envelope from the current frame to an increasing signal envelope for the next frame. Such a technique can be described as "overlap windowing", and is well known in the prior art. An example of an overlap window is given in equation 4.1.2.1-3 as described in Cellular System Remote unit-Base Station Compatibility Standard of the Electronic Industry Association/Telecommunications Industry Association Interim Standard 127 as:

$$g(n) = \begin{cases} d(n, m)\sin^2(\pi(n + 0.5)/2D), & 0 \le n < D, \\ d(n, m), & D \le n < L, \\ d(n, m)\sin^2(\pi(n - L + D + 0.5)/2D), & L \le n < D + L, \\ 0, & D + L \le n < M \end{cases}$$

where g(n) is the windowed, zero-padded input sequence, d(n,m) is the input signal, n is the sample index, m is the frame index, D is the overlap delay, L is the frame length, and M is the FFT length. Here, we are interested in the increasing signal envelope at the beginning of the frame (samples 0 to D−1), and the decreasing signal envelope near the end of the frame (samples L to D+L−1). The significance of these envelopes is that when the signal is reconstructed at the noise suppression output, the output signal with the increasing signal envelope at the beginning of the current frame will be added to the output signal with the decreasing envelope from the previous frame. As one skilled in the art would appreciate, the sum of the two envelopes (windows) yields the trigonometric identity function:

$$\sin^2(\pi(n+0.5)/2D)+\cos^2(\pi(n+0.5)/2D)=1$$

Thus, the signal at the overlap portions of the noise suppression output will be reconstructed properly due to the sum of the overlapping windows having unity weight.

While this method is effective in smoothing frame discontinuities, it also produces an increase in delay through the noise suppression system. This is due to the fact that the samples for the next frame are not yet available for the addition process, so the addition of these samples to the overlap section of the current frame must be delayed until the next frame is processed. Thus, there exists a tradeoff between performance and delay, with greater smoothing intervals leading to better performance and the longer the delays.

The delay problem is compounded when noise suppression is included as part of a speech coding system, as is the case with many wireless digital communications systems. In such systems, the speech coder also adds delay, typically in the form of what is known as linear predictive coding (LPC) "look-ahead" delay. This delay comprises an additional buffering (via buffer 110) that is required to extend speech samples beyond the current frame for the purposes of estimating the short-term spectrum towards the end of the current frame. The reason being is that the spectral parameters (or LP parameters) are interpolated over shorter time intervals (called sub-frames), and it is desirable for the current set of LP parameters to be representative of the center of the last sub-frame of the current frame. This however, requires an LPC analysis buffer that extends beyond the frame currently being coded, which incurs delay. As is the case with noise suppression, there is a tradeoff between performance and delay.

Thus, for typical LPC analysis, analyzer 111 accesses buffer 110. As discussed above, speech samples beyond the current frame are included in the analysis buffer 110. The window that is applied to the current analysis buffer may be symmetric or non-symmetric based on the amount of look-ahead delay that is used and the length of analysis buffer circuitry 111. As is known in the art, autocorrelation analysis is applied, which is followed by a process to solve the autocorrelation "normal equations", known as the Levinson-Durbin recursion. The result is a set of direct form LP coefficients (A(z)), which are used by the speech coder to represent the short-term spectral envelope.

FIG. 3 illustrates the interactions between the prior-art noise suppressor and LPC analysis processes. In particular, FIG. 3 shows the relationship in time, along the horizontal dimension, between the various buffer elements, and how those elements contribute to system delay. This example assumes that the digital system has a sampling frequency of 8000 Hz and operates on 20 millisecond (ms) frames, as is common in wireless telephony applications, which corresponds to a frame length of 160 samples. As one skilled in the art will appreciate, various sampling frequencies and frames lengths are possible. The relative timing is indicated in FIG. 3 by the sample indices at the top of the diagram. Here it is assumed that the current sample is n=0, which represents the last sample received in input frame m. Upon receiving the last sample in frame m, the noise suppression analysis window 302 is applied to the input frame 301.

As is evident, the analysis window overlaps with the previous frame by 40 samples (or 5 ms). This overlap facilitates the inter-frame smoothing as discussed previously, which after noise suppression is applied, produces a corresponding output from the noise suppression synthesis circuitry 303. Although a 40 sample overlap is used, other values (up to 160 samples) are possible. Here it can be seen how the overlapping of the frames contributes to the source of the delay. Particularly, for the given frame m, the corresponding noise suppression output frame represents samples that were received 5 ms earlier. This delay is denoted as $D_{ns}$ on the lower right of the diagram. The noise suppression output is then loaded directly in the LPC analysis buffer 304.

From FIG. 3 it can be seen that the coded speech frame 306 is divided into sub-frames, each of length 40 samples (5 ms). As mentioned earlier, in order for the LP parameter interpolation to be effective, the center of the LPC analysis frame should be aligned with the center of the last sub-frame. In order to accomplish this objective, asymmetric LPC analysis circuitry 305 is used to weight the samples towards the front of the LPC analysis buffer with greater magnitude than the samples towards the rear of the LPC analysis buffer. For this example, the LPC analysis look-ahead (given as $D_{lpc}$) is 40 samples (5 ms), and the LPC analysis circuitry length is 160 samples (20 ms). The following should be noted:

- Symmetric LPC circuitry typically provides better performance than asymmetric circuitry due to reduced spectral smearing and narrower main lobe responses.
- LPC analysis circuitry can generally be made symmetric by increasing algorithmic delay (look-ahead).

Supporting evidence for the first point can be found in FIG. 4. The top plot shows a Hamming window $w_1(n)$, which is well known in the art, and an asymmetric window $w_2(n)$, which is commonly used in practice. The asymmetric window consists of the first half of a Hamming window for the first 108 samples, followed by a trailing quarter wavelength sine wave for the last 52 samples. This window has been designed such that the weighted energy of the window is centered about sample number n=100. This value of n is chosen by taking the LPC buffer length (L=160), and subtracting the look-ahead ($D_{lpc}$=40) plus half of the sub-frame length (20). The bottom plot shows the respective frequency responses for each of the windows, which were obtained by taking the log magnitude of the DFT of each of the windows. From this plot it is clear that the asymmetric window exhibits increased spectral leakage in the 100 to 200 Hz range, which could result in noticeable degradation in quality when compared to a similar symmetric window with slightly increased look-ahead delay.

Because in a two-way voice communications system, it is desirable to minimize round-trip delay while maximizing audio quality, there is a need for a method and apparatus for coding a noise-suppressed signal that could consolidate the noise suppression and LPC analysis delays into a lesser net delay, while maintaining the same audio quality, or conversely, maintain a given delay while improving overall audio quality.

DETAILED DESCRIPTION OF THE DRAWINGS

To address the above-mentioned need, a method and apparatus for coding a noise suppressed audio signal is described herein. In accordance with the preferred embodiment of the present invention an unfiltered frame portion from a second frame is blended together with a filtered frame portion from a first frame to produce a combined frame portion. The combined frame portion is then buffered along with the filtered frame for LPC analysis.

Since the unfiltered frame portion from a second frame is blended together with a filtered frame portion from a first frame system delay is greatly reduced. More particularly, since the unfiltered frame portion for the next frame is immediately available for combining, the delay incurred by prior-art filtering is eliminated.

The present invention encompasses method comprising the steps of filtering a first frame of data to produce a filtered first frame, combining a portion of the filtered first frame with an unfiltered portion of a second frame to produce a combined portion, and substituting the combined portion for the portion of the filtered first frame.

The present invention additionally encompasses a method for coding a noise-suppressed signal. The method comprises the steps of performing noise suppression on a first frame of data to produce a noise-suppressed first frame, overlapping and adding a portion of the noise-suppressed first frame with a non-noise suppressed portion of a second frame to produce a combined portion, and substituting the combined portion for the portion of the noise-suppressed first frame. Linear predictive coding (LPC) is then performed on the noise-suppressed first frame containing the combined portion.

The present invention additionally encompasses an apparatus comprising a filter having a first frame of data as an input and outputting a filtered first frame. The apparatus additionally encompasses a signal combiner having a portion of the filtered first frame as an input and a portion of an unfiltered second frame as an input and outputting a combined portion, wherein the combined portion comprises an addition of the portion of the filtered first frame with the portion of the unfiltered second frame. Finally, the apparatus comprises a buffer storing the filtered first frame having the combined portion substituted for the portion of the filtered first frame.

Figure 5:
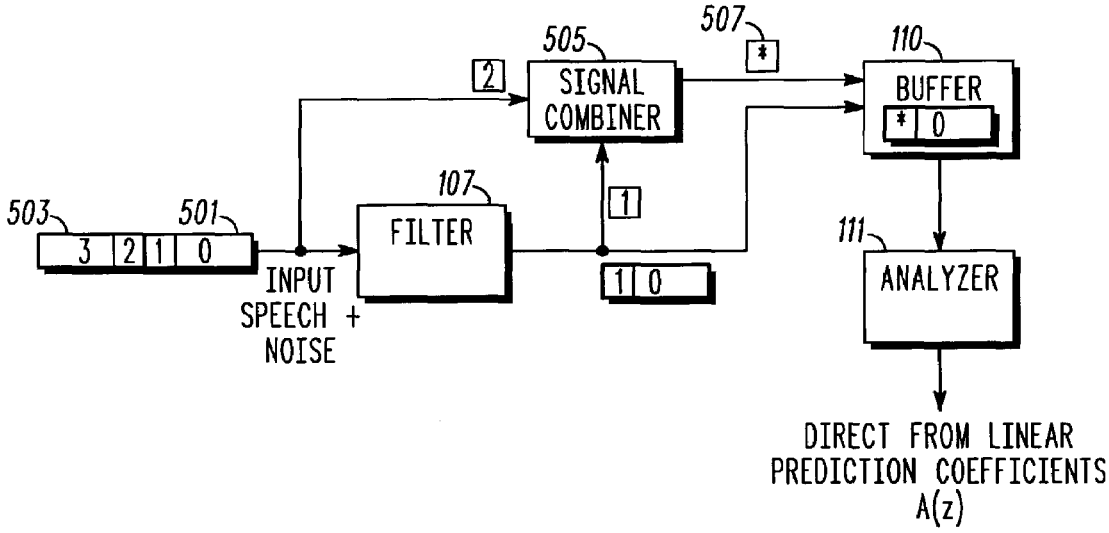
FIG. 5 is a block diagram of an apparatus for coding a filtered signal in accordance with the preferred embodiment of the present invention.

Turning now to the drawings, wherein like numerals designate like components, FIG. 5 is a block diagram of apparatus 500 for coding a noise-suppressed signal in accordance with the preferred embodiment of the present invention. As shown, frames 501 and 503 enter filter 510 and signal combiner 505. As is evident, frames 501 and 503 contain frame portions 0-1, and 2-3, respectively. As in the prior-art, in the preferred embodiment of the present invention adjacent frames are blended together by adding a decreasing signal envelope from the current frame to an increasing signal envelope for the next frame. Thus, in the preferred embodiment of the present invention, frame portion 1 is blended together with frame portion 2 via standard overlap-and-add techniques. However, unlike the prior-art, an unfiltered frame portion 2 is blended together with a filtered frame portion 1 to produce frame portion 507. Frame portion 507 is then buffered along with filtered frame 501 for LPC analysis. More particularly, frame portion 507 is utilized by analyzer 111 in place of frame portion 1.

Since filter 510 performs filtering on frames as a whole, a filtered portion 2 of frame 503 is unavailable until the whole of frame 503 is filtered. Thus a filtered frame portion (2) for the next frame is unavailable for a period of time after the current frame has been filtered. However, this problem is alleviated in the preferred embodiment of the present invention since frame portion 2 (of frame 503) is not filtered prior to addition with frame portion 1 (of frame 501).

Figure 6:
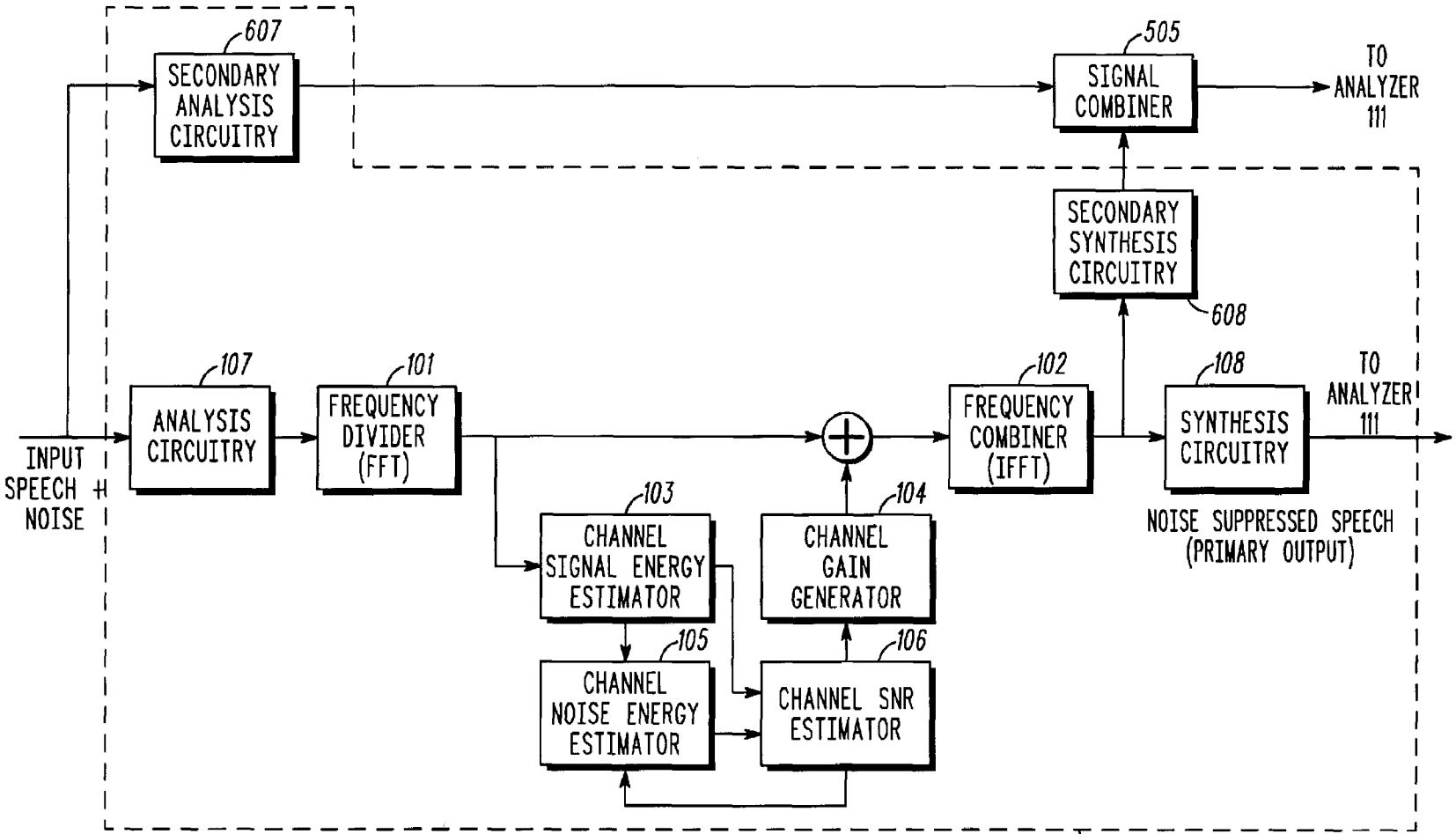
FIG. 6 is a more-detailed block diagram of an apparatus for coding a noise-suppressed signal in accordance with the preferred embodiment of the present invention.

FIG. 6 is a block diagram of noise-suppression system 600 in accordance with a preferred embodiment of the present invention. As is evident, filter 510 has been replaced by modified noise-suppression circuitry 601. In the preferred embodiment of the present invention noise-suppression circuitry 601 comprises standard noise suppression circuitry with the addition of secondary analysis circuitry 607, secondary synthesis circuitry 608, and signal combiner 505. The secondary analysis and synthesis circuitry are used to weight the respective overlap portions of the respective noise suppression inputs and outputs. These weighted signals are then combined via combiner 505 to form an "auxiliary" output that is used to fill the front portion of LPC analysis buffer 110, thereby extending the LPC analysis buffer by an amount equal to the noise suppression overlap-and-add delay. More particularly, the delay incurred by the noise suppressor is transferred into the LPC look-ahead by providing a sub-optimal zero-delay auxiliary output signal for temporary use by the LPC analysis circuit. Once this auxiliary signal has been used in the LPC analysis circuit the auxiliary signal can be discarded.

Figure 4:
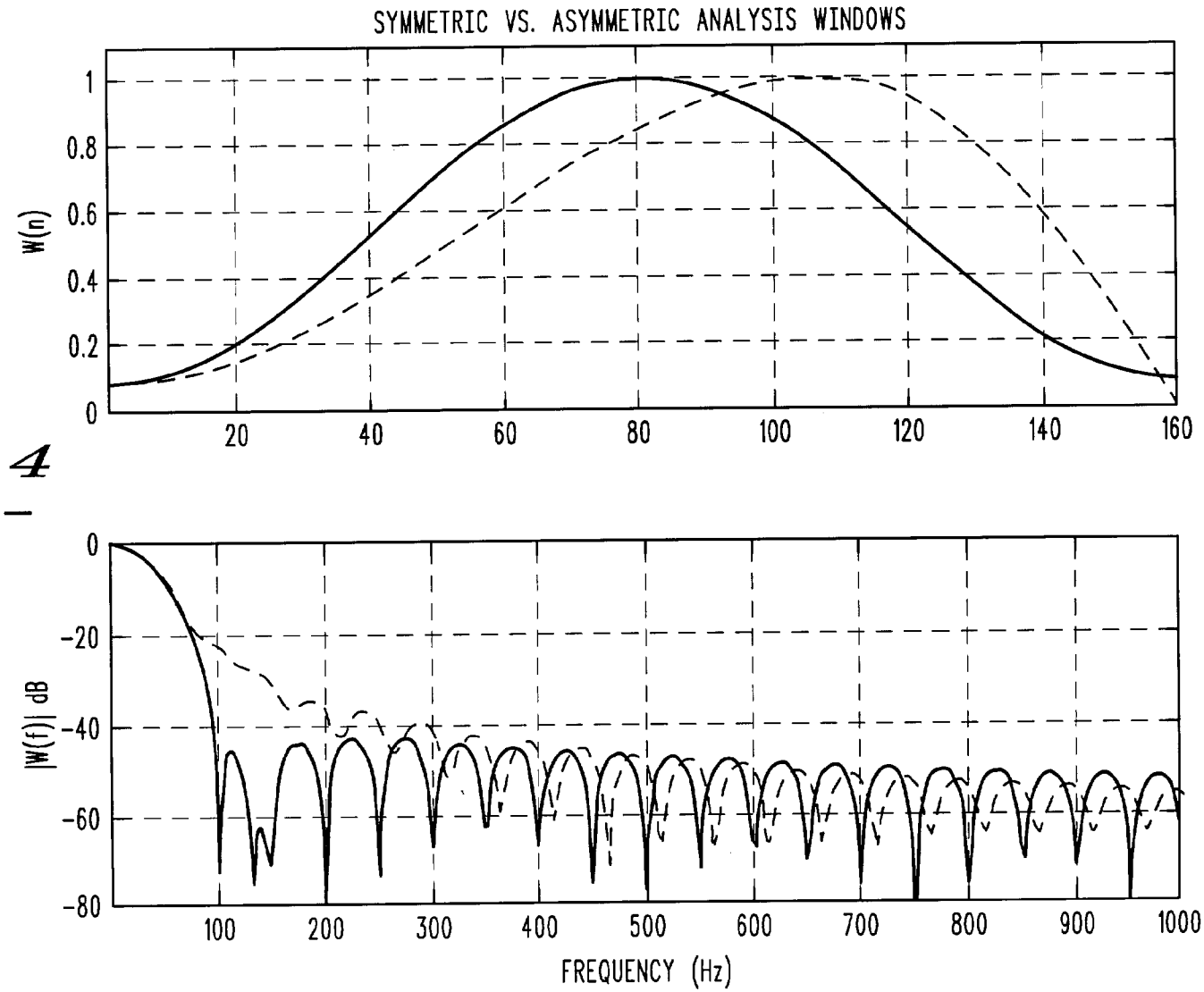
FIG. 4 compares the use of Hamming windows and asymmetric windows.
Figure 7:
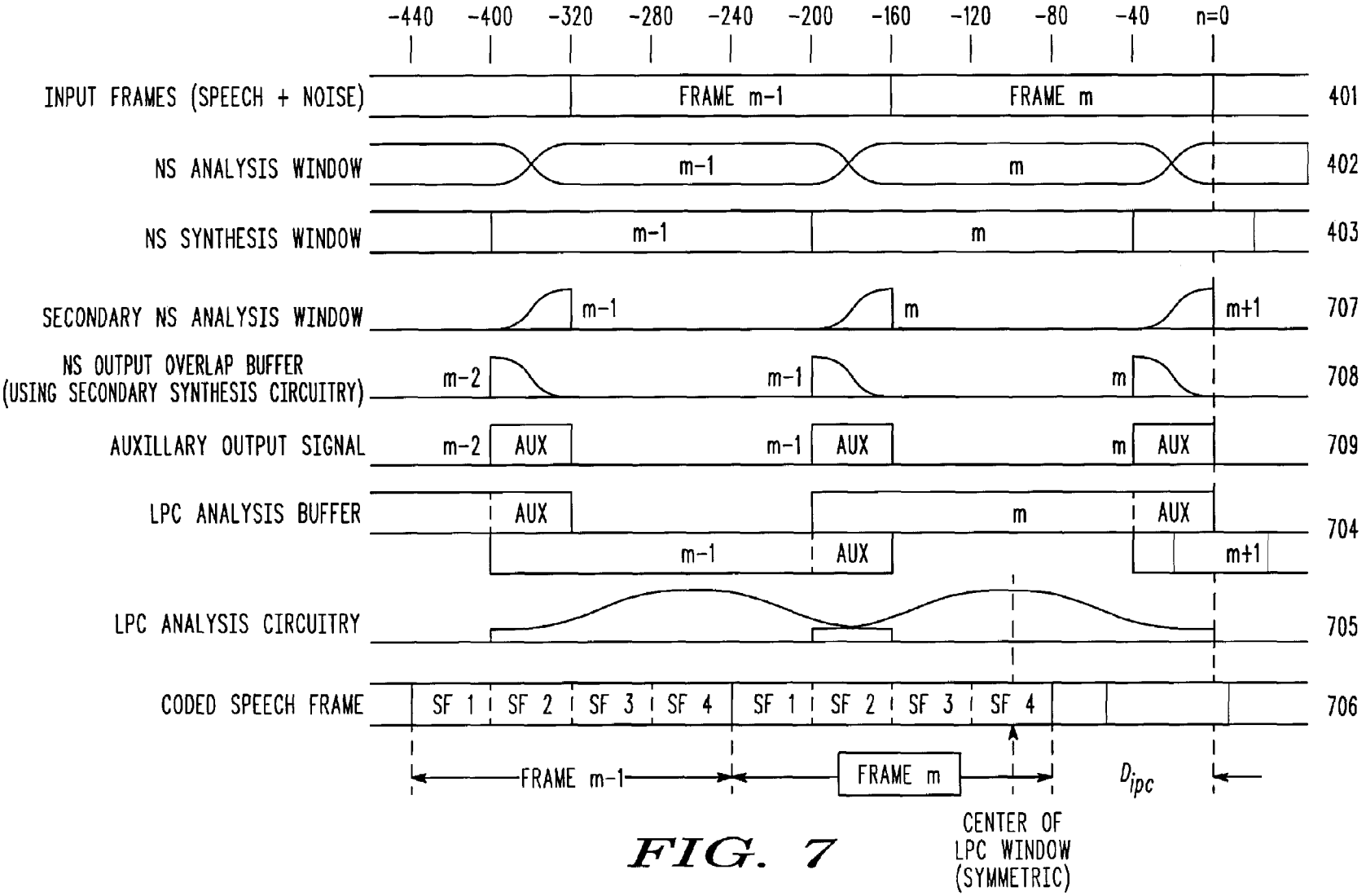
FIG. 7 illustrates the interactions between the noise suppressor and LPC analysis processes.

FIG. 7 illustrates operation of the circuitry of FIG. 6. As in FIG. 4, the noise suppression circuit produces a primary output that is subsequently loaded into LPC analysis buffer 704. The secondary analysis window 707 is applied via circuitry 607 to the overlapped section of the input signal and serves to create an increasing signal envelope for the next sub-frame. This portion of the input signal is normally used at the beginning on the next frame m+1, but for the purposes of the present invention, it is added to the overlapped section of the noise suppression output signal 708 (which is made available through the secondary synthesis circuitry 608) to produce the auxiliary output signal 709. More particularly, secondary analysis circuitry 607 creates an increasing signal envelope for a next unfiltered sub-frame while secondary synthesis circuitry 608 creates a decreasing signal envelope for the current filtered sub-frame.

A combined signal is produced by adding the outputs of the secondary analysis circuitry and the secondary synthesis circuitry. This combined signal is then loaded into the front of LPC analysis buffer 704. As one skilled in the art may now notice, the noise suppression delay $D_{ns}$ has been eliminated, and the look-ahead delay $D_{lpc}$ has been increased from 40 samples (5 ms) to 80 samples (10 ms). This is important in the sense that, despite using a sub-optimal auxiliary signal in the LPC look-ahead, a symmetric LPC window 705 may be used to improve quality when compared to the prior art system in FIG. 4, which uses an asymmetric LPC window 405. It is also important to note that the total algorithmic delay through both systems is identical.

Figure 8:
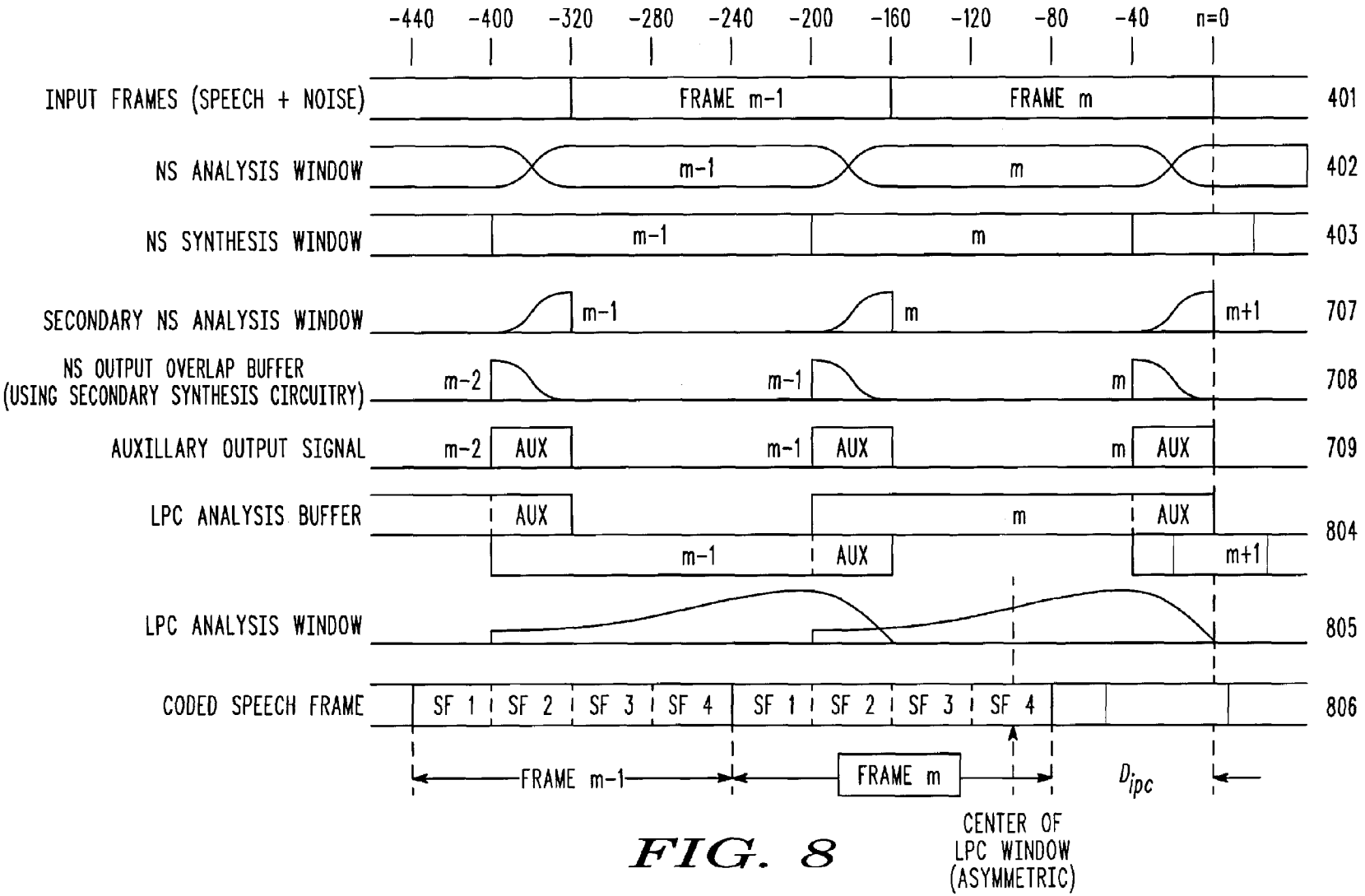
FIG. 8 illustrates the interactions between the noise suppressor and LPC analysis processes.

A further embodiment of the present invention is illustrated in FIG. 8. In this embodiment of the present invention, the LPC look-ahead (within the LPC analysis buffer 804) is comprised completely from the auxiliary output signal 709. The use of an asymmetric LPC window 805 in this particular embodiment facilitates a reduction in total algorithmic delay to $D_{lpc}$=40 samples (5 ms). Although the use of an asymmetric LPC window may likely reduce overall sound quality when compared to a similar system that employs a symmetric window (as in FIG. 7), the embodiment in FIG. 8 may be used in applications where algorithmic delay is of primary concern.

Since the present invention utilizes a linear phase noise suppression circuit, the signals presented to the signal combiner 505 are generally phase aligned, which enables an input signal with relatively high SNR to be reconstructed very readily for use in the LPC analysis buffers. But in the cases where noisy (i.e., lower SNR) signals are encountered, the preceding embodiments may suffer in that the auxiliary output signal is comprised of both noise suppressed and non-noise suppressed audio samples. In this case it is beneficial to employ the circuit given in FIG. 9.

Figure 1:
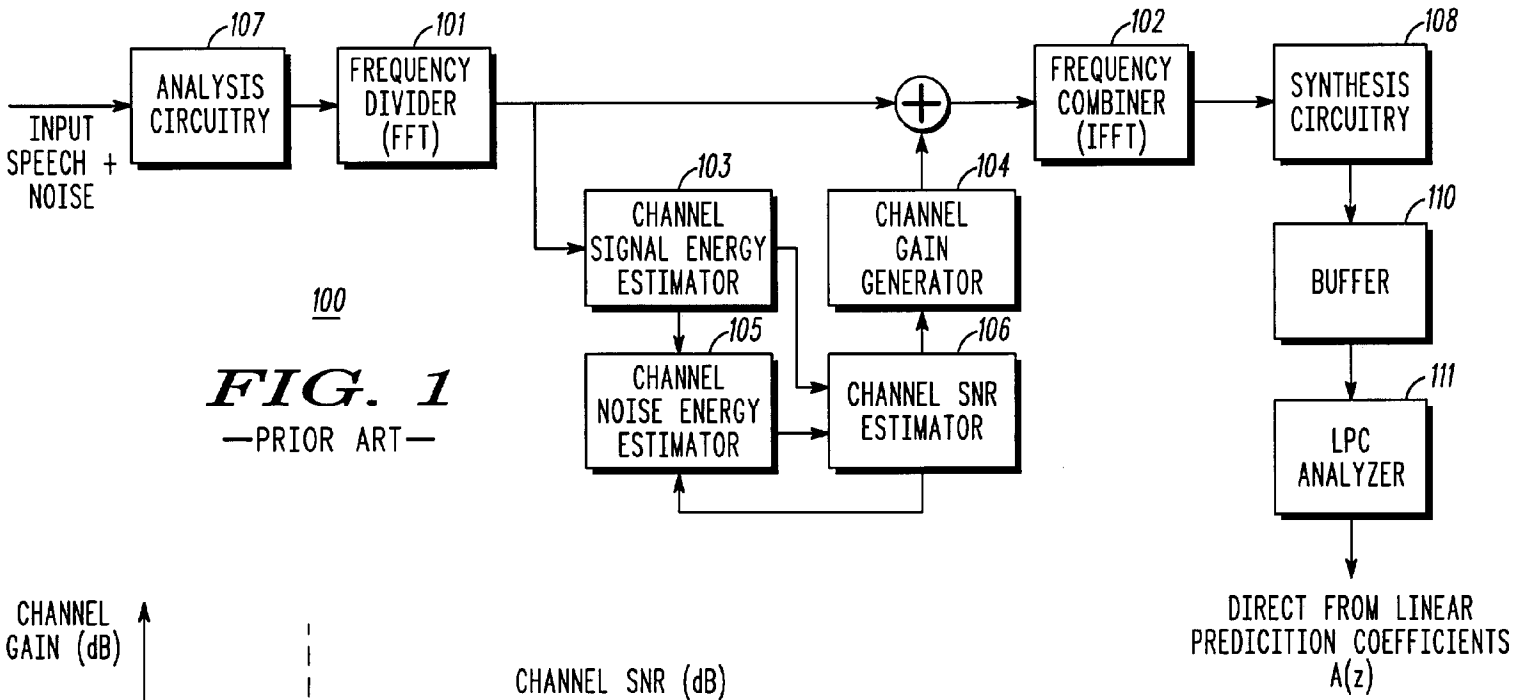
FIG. 1 is a block diagram of a prior-art noise suppression system.
Figure 2:
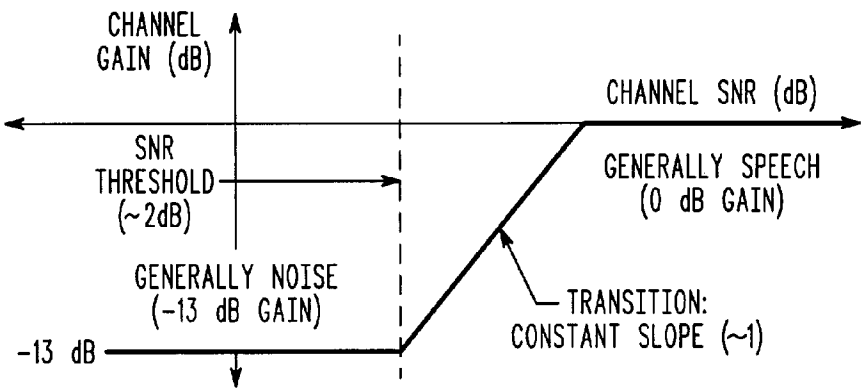
FIG. 2 is a graph illustrating prior-art channel gain as a function of SNR.
Figure 3:
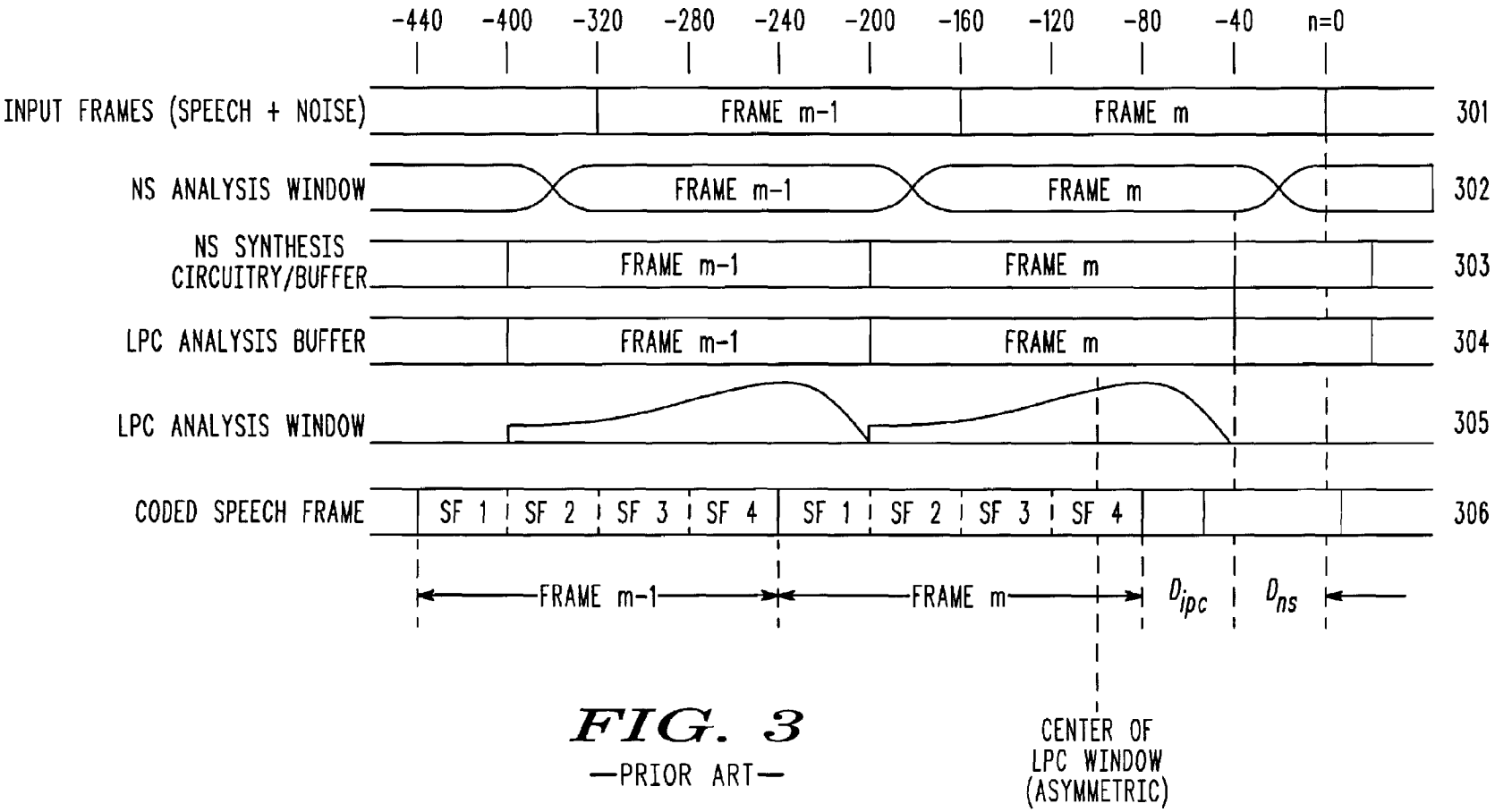
FIG. 3 illustrates the interactions between the prior-art noise suppressor and LPC analysis processes.
Figure 9:
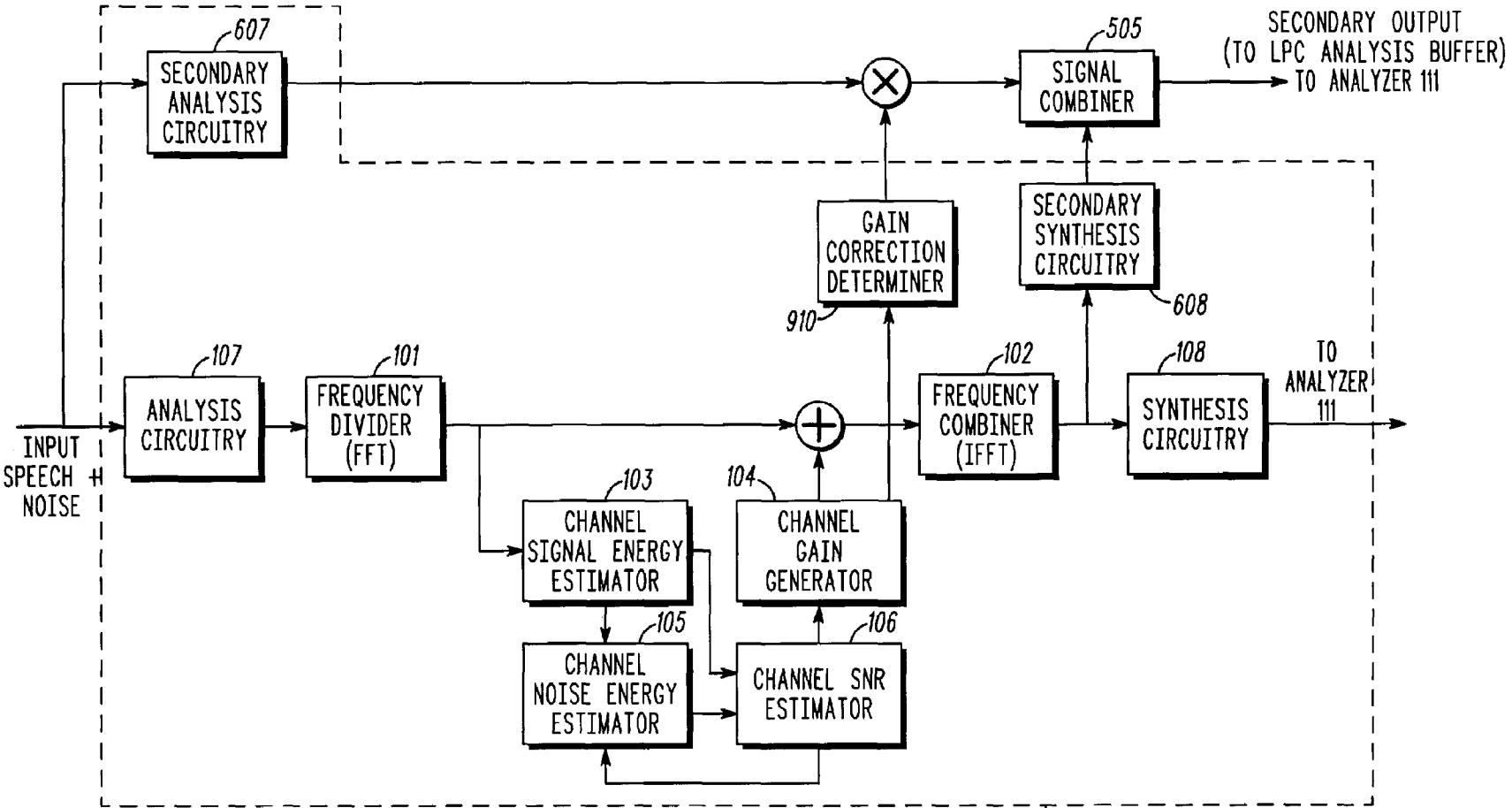
FIG. 9 is a block diagram of an apparatus for coding a noise-suppressed signal in accordance with a further embodiment of the present invention.
Figure 10:
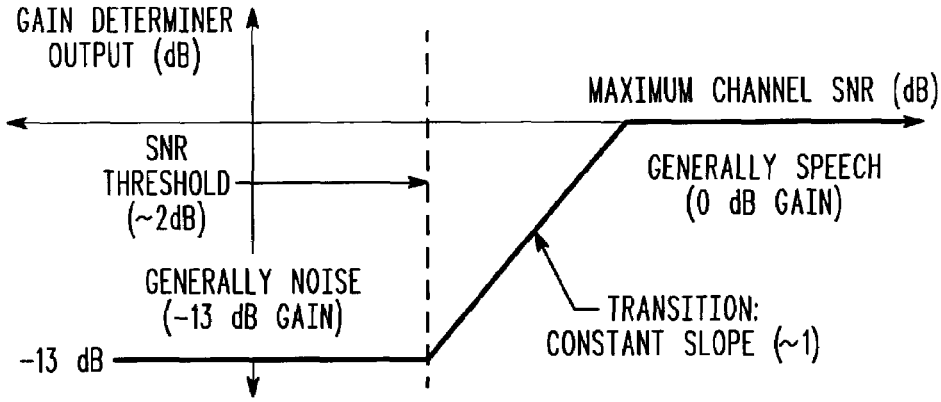
FIG. 10 illustrates gain applied as a function of signal-to-noise (SNR).

As shown in FIG. 9, the addition of the gain correction determiner 910 uses some function of the channel gain generator 104 to produce a variable scale factor, which is used to attenuate the signal produced by the secondary analysis circuitry 607 prior to entering the signal combiner 505. In the preferred embodiment, the function used by the gain correction determiner comprises the maximum value of the channel gain vector, as applied to the signal vector leaving the frequency divider block 101. This has the effect of preserving the amplitude of any signal that has relatively small levels of speech, while providing a maximum level of attenuation for noise only signals. This function can be observed in FIG. 10, which is conceptually similar to the channel gain function given in FIG. 2.

As one skilled in the art may appreciate, other functions within the gain determiner are possible, including average gain, median gain, etc., without deviating from the scope of the present invention. Additionally, other noise suppression state variables may be used to assist in a variation of the gain determiner output. Furthermore, the preferred embodiment of the present invention has been described using an 8000 Hz sampling rate, a 20 ms frame length, a 5 ms sub-frame length, a 5 ms noise suppression delay, and a 5 ms look-ahead delay. It is obvious to one skilled in the art that other such parameters may be used without departing from the scope of the present invention.

Figure 11:
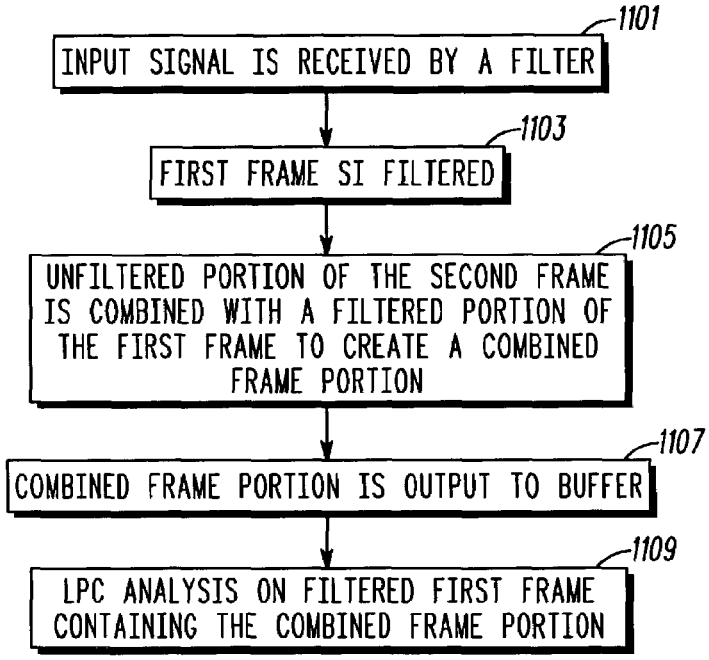
FIG. 11 is a flow chart showing operation of the apparatus of FIG. 5 in accordance with the preferred embodiment of the present invention.

FIG. 11 is a flow chart illustrating the coding of a filtered signal in accordance with the preferred embodiment of the present invention. The logic flow begins at step 1101 where an input signal is received by filter 510 and signal combiner 501. As discussed above, the input signal to filter 510 comprises a first frame of data 501 having a first and a second portion (0 and 1), while the input signal to combiner 501 comprises a portion (2) of a second frame 503. At step 1103 the first frame is filtered via filter 510. As discussed above, in the preferred embodiment of the present invention filter 510 comprises noise-suppression circuitry, however one of ordinary skill in the art will recognize that filter 510 may comprise other forms of filters, such as, but not limited to speech enhancement filters, Weiner filters, sub-band filters, and noise canceling filters.

Continuing, at step 1105 an unfiltered portion of the second frame is combined with a filtered portion of the first frame to create combined frame portion 507. As discussed above, the combined frame portion blends signal discontinuities associated with the dynamics of the noise suppression system. More specifically, as the input speech+noise frames are processed, the filter gain characteristics within channel gain generator 104 change from frame to frame, thus leaving the potential for abrupt changes in output signal content at frame boundaries. In order to alleviate this problem, adjacent frames are blended together by adding portions of each frame.

At step 1107 the combined frame portion is output to buffer 110 along with the filtered first frame. In the preferred embodiment of the present invention the filtered portion of the first frame is replaced by the combined frame portion. At step 1109 LPC analysis circuitry 111 performs LPC analysis on filtered first frame containing the combined frame portion.

While the invention has been particularly shown and described with reference to a particular embodiment, it will be understood by those skilled in the art that various changes in form and details may be made therein without departing from the spirit and scope of the invention. For example, while the preferred embodiment has specified the use of a noise suppressor with a speech coder that utilizes LPC analysis, certain generic preprocessor and coding methods exists which also use overlap-and-add systems coupled to spectral analysis. Furthermore, any type of signal analysis (not limited to spectral analysis) can be employed, if that analysis allows the extended signal from the preprocessor to be discarded once the true signal becomes available. It is intended that such changes come within the scope of the following claims.

The invention claimed is:

1. A method for creating noise-suppressed speech, the method comprising the steps of:

receiving a frame of speech plus noise data;

filtering the frame of speech plus noise data to produce a filtered frame;

weighting a portion of the frame of speech plus noise data to produce an increasing envelope portion of the speech plus noise frame;

weighting a portion of the filtered frame to produce a decreasing envelope portion of the filtered frame;

combining the decreasing envelope portion of the filtered frame with the increasing envelope portion of the speech plus noise frame to produce a combined portion; and outputting noise-suppressed speech based on the filtered frame and the combined portion.

2. The method of claim 1 further comprising the step of:

performing linear predictive coding (LPC) on the noise suppressed speech.

3. The method of claim 1 wherein the step of filtering comprises the step of performing noise suppression on the frame of speech plus noise.

4. The method of claim 1 wherein the step of combining comprises the step of overlapping and adding the decreasing envelope portion of the filtered frame with the increasing envelope portion of the speech plus noise frame.

5. An apparatus for outputting linear prediction coefficients, the apparatus comprising:

a filter receiving a frame of speech plus noise data and filtering the frame of speech plus noise data to produce a filtered frame;

analysis circuitry weighting a portion of the frame of speech plus noise data to produce an increasing envelope portion of the speech plus noise frame;

synthesis circuitry weighting a portion of the filtered frame to produce a decreasing envelope portion of the filtered frame; and a signal combiner combining the decreasing envelope portion of the filtered frame with the increasing envelope portion of the speech plus noise frame to produce a combined portion, and outputting noise-suppressed speech based on the filtered frame and the combined portion.

6. The apparatus of claim 5 further comprising:

a linear predictive coding (LPC) analyzer having the noise-suppressed speech as an input.

* * * * *